US009351387B2

(12) United States Patent
Wang

(10) Patent No.: US 9,351,387 B2
(45) Date of Patent: May 24, 2016

(54) GRID VOLTAGE GENERATION FOR X-RAY TUBE

(71) Applicant: Moxtek, Inc., Orem, UT (US)

(72) Inventor: Dongbing Wang, Lathrop, CA (US)

(73) Assignee: Moxtek, Inc., Orem, UT (US)

( * ) Notice: Subject to any disclaimer, the term of this patent is extended or adjusted under 35 U.S.C. 154(b) by 0 days.

(21) Appl. No.: 14/720,338

(22) Filed: May 22, 2015

(65) Prior Publication Data

US 2015/0257244 A1 Sep. 10, 2015

Related U.S. Application Data

(62) Division of application No. 14/038,226, filed on Sep. 26, 2013, now Pat. No. 9,072,154.

(60) Provisional application No. 61/740,944, filed on Dec. 21, 2012.

(51) Int. Cl.

| | |
|---|---|
| ***H05G 1/12*** | (2006.01) |
| ***H05G 1/10*** | (2006.01) |
| ***H05G 1/08*** | (2006.01) |
| ***H05G 1/00*** | (2006.01) |
| ***H05G 1/06*** | (2006.01) |

(52) U.S. Cl.

CPC . *H05G 1/12* (2013.01); *H05G 1/00* (2013.01); *H05G 1/06* (2013.01); *H05G 1/08* (2013.01); *H05G 1/085* (2013.01); *H05G 1/10* (2013.01)

(58) Field of Classification Search

None

See application file for complete search history.

(56) References Cited

U.S. PATENT DOCUMENTS

| | | | | |
|---|---|---|---|---|
| 1,946,288 | A | 2/1934 | Kearsley | |
| 2,291,948 | A | 8/1942 | Cassen | |
| 2,316,214 | A | 4/1943 | Atlee et al. | |
| 2,329,318 | A | 9/1943 | Atlee et al. | |
| 2,683,223 | A | 7/1954 | Hosemann | |
| 2,853,623 | A | 9/1958 | Kerns | |
| 2,952,790 | A | 9/1960 | Steen | |
| 3,469,023 | A | 9/1969 | Neal | |
| 3,679,927 | A | 7/1972 | Kirkendall | |
| 3,740,571 | A * | 6/1973 | Richards, Jr. | G05F 1/46 307/55 |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS http://www.orau.org/ptp/collection/xraytubescollidge/MachelettCW250.htm, 1999,2 pages.

*Primary Examiner* — Michael Logie

(74) *Attorney, Agent, or Firm* — Thorpe, North & Western, LLP

(57) ABSTRACT

An x-ray source for improved electron beam control, a smaller electron beam spot size, and a smaller x-ray spot size with reduced power supply size and weight. A method for improved electron beam control, a smaller electron beam spot size, and a smaller x-ray spot size with reduced power supply size and weight. Grid(s) may be used in an x-ray tube for improved electron beam control, a smaller electron beam spot size, and a smaller x-ray spot size. Control circuitry for the grid(s) can be disposed in electrically insulative potting. Light may be used to provide power and control signals to the control circuitry.

20 Claims, 6 Drawing Sheets

(56) References Cited

U.S. PATENT DOCUMENTS

| | | | | |
|---|---|---|---|---|
| 3,751,701 | A | 8/1973 | Gralenski et al. | |
| 3,801,847 | A | 4/1974 | Dietz | |
| 3,882,339 | A | 5/1975 | Rate et al. | |
| 4,007,375 | A | 2/1977 | Albert | |
| 4,075,526 | A | 2/1978 | Grubis | |
| 4,104,526 | A | 8/1978 | Albert | |
| 4,184,097 | A | 1/1980 | Auge | |
| 4,378,501 | A * | 3/1983 | Cowell | H05G 1/12 378/106 |
| 4,400,822 | A | 8/1983 | Kuhnke et al. | |
| 4,481,654 | A | 11/1984 | Daniels et al. | |
| 4,504,895 | A | 3/1985 | Steigerwald | |
| 4,521,902 | A | 6/1985 | Peugeot | |
| 4,573,186 | A | 2/1986 | Reinhold | |
| 4,679,219 | A | 7/1987 | Ozaki | |
| 4,688,241 | A | 8/1987 | Peugeot | |
| 4,734,924 | A | 3/1988 | Yahata et al. | |
| 4,761,804 | A | 8/1988 | Yahata | |
| 4,777,642 | A | 10/1988 | Ono | |
| 4,797,907 | A | 1/1989 | Anderton | |
| 4,870,671 | A | 9/1989 | Hershyn | |
| 4,878,866 | A | 11/1989 | Mori et al. | |
| 4,891,831 | A | 1/1990 | Tanaka et al. | |
| 4,969,173 | A | 11/1990 | Valkonet | |
| 4,979,199 | A | 12/1990 | Cueman et al. | |
| 4,995,069 | A | 2/1991 | Tanaka | |
| 5,077,771 | A | 12/1991 | Skillicorn et al. | |
| 5,077,777 | A | 12/1991 | Daly | |
| 5,105,456 | A | 4/1992 | Rand et al. | |
| 5,187,737 | A | 2/1993 | Watanabe | |
| 5,200,984 | A | 4/1993 | Laeuffer | |
| RE34,421 | E | 10/1993 | Parker et al. | |
| 5,343,112 | A | 8/1994 | Wegmann | |
| 5,347,571 | A | 9/1994 | Furbee et al. | |
| 5,400,385 | A | 3/1995 | Blake et al. | |
| 5,422,926 | A | 6/1995 | Smith | |
| 5,428,658 | A | 6/1995 | Oettinger et al. | |
| 5,469,490 | A | 11/1995 | Golden et al. | |
| RE35,383 | E | 11/1996 | Miller et al. | |
| 5,621,780 | A | 4/1997 | Smith et al. | |
| 5,627,871 | A | 5/1997 | Wang | |
| 5,631,943 | A | 5/1997 | Miles | |
| 5,680,433 | A | 10/1997 | Jensen | |
| 5,682,412 | A | 10/1997 | Skillicorn et al. | |
| 5,696,808 | A | 12/1997 | Lenz | |
| 5,729,583 | A | 3/1998 | Tang et al. | |
| 5,812,632 | A | 9/1998 | Schardt et al. | |
| 5,907,595 | A | 5/1999 | Sommerer | |
| 5,978,446 | A | 11/1999 | Resnick | |
| 6,005,918 | A | 12/1999 | Harris et al. | |
| 6,044,130 | A | 3/2000 | Inazura et al. | |
| 6,075,839 | A | 6/2000 | Treseder | |
| 6,097,790 | A | 8/2000 | Hasegawa et al. | |
| 6,134,300 | A | 10/2000 | Trebes et al. | |
| 6,205,200 | B1 | 3/2001 | Boyer et al. | |
| 6,282,263 | B1 | 8/2001 | Arndt et al. | |
| 6,351,520 | B1 | 2/2002 | Inazaru | |
| 6,385,294 | B2 | 5/2002 | Suzuki et al. | |
| 6,438,207 | B1 | 8/2002 | Chidester et al. | |
| 6,477,235 | B2 | 11/2002 | Chornenky et al. | |
| 6,487,272 | B1 | 11/2002 | Kutsuzawa | |
| 6,487,273 | B1 | 11/2002 | Takenaka et al. | |
| 6,494,618 | B1 | 12/2002 | Moulton | |
| 6,546,077 | B2 | 4/2003 | Chornenky et al. | |
| 6,567,500 | B2 | 5/2003 | Rother | |
| 6,646,366 | B2 | 11/2003 | Hell et al. | |
| 6,661,876 | B2 | 12/2003 | Turner et al. | |
| 6,778,633 | B1 | 8/2004 | Loxley et al. | |
| 6,799,075 | B1 | 9/2004 | Chornenky et al. | |
| 6,803,570 | B1 | 10/2004 | Bryson, III et al. | |
| 6,816,573 | B2 | 11/2004 | Hirano et al. | |
| 6,819,741 | B2 | 11/2004 | Chidester | |
| 6,876,724 | B2 | 4/2005 | Zhou | |
| 6,976,953 | B1 | 12/2005 | Pelc | |
| 6,987,835 | B2 | 1/2006 | Lovoi | |
| 7,035,379 | B2 | 4/2006 | Turner et al. | |
| 7,046,767 | B2 | 5/2006 | Okada et al. | |
| 7,049,735 | B2 | 5/2006 | Ohkubo et al. | |
| 7,050,539 | B2 | 5/2006 | Loef et al. | |
| 7,085,354 | B2 | 8/2006 | Kanagami | |
| 7,130,380 | B2 | 10/2006 | Lovoi et al. | |
| 7,130,381 | B2 | 10/2006 | Lovoi et al. | |
| 7,203,283 | B1 | 4/2007 | Puusaari | |
| 7,206,381 | B2 | 4/2007 | Shimono et al. | |
| 7,215,741 | B2 | 5/2007 | Ukita | |
| 7,224,769 | B2 | 5/2007 | Turner | |
| 7,286,642 | B2 | 10/2007 | Ishikawa et al. | |
| 7,305,066 | B2 | 12/2007 | Ukita | |
| 7,317,784 | B2 | 1/2008 | Durst et al. | |
| 7,382,862 | B2 | 6/2008 | Bard et al. | |
| 7,428,298 | B2 | 9/2008 | Bard et al. | |
| 7,448,801 | B2 | 11/2008 | Oettinger et al. | |
| 7,448,802 | B2 | 11/2008 | Oettinger et al. | |
| 7,526,068 | B2 | 4/2009 | Dinsmore | |
| 7,529,345 | B2 | 5/2009 | Bard et al. | |
| 7,634,052 | B2 | 12/2009 | Grodzins et al. | |
| 7,649,980 | B2 | 1/2010 | Aoki et al. | |
| 7,657,002 | B2 | 2/2010 | Burke et al. | |
| 7,693,265 | B2 | 4/2010 | Hauttmann et al. | |
| 7,839,254 | B2 | 11/2010 | Dinsmore et al. | |
| 7,983,394 | B2 | 7/2011 | Kozaczek et al. | |
| 8,247,971 | B1 | 8/2012 | Bard | |
| 8,526,574 | B2 | 9/2013 | Wang et al. | |
| 8,750,458 | B1 | 6/2014 | Wang et al. | |
| 8,804,910 | B1 | 8/2014 | Wang et al. | |
| 8,903,047 | B1 | 12/2014 | Wang et al. | |
| 8,995,620 | B2 | 3/2015 | Wang | |
| 8,995,621 | B2 | 3/2015 | Wang et al. | |
| 9,072,155 | B2 | 6/2015 | Wang | |
| 9,087,670 | B2 | 7/2015 | Wang | |
| 2004/0076260 | A1 | 4/2004 | Charles, Jr et al. | |
| 2004/0264643 | A1 * | 12/2004 | Chretien | H05G 1/34 378/109 |
| 2005/0018817 | A1 * | 1/2005 | Oettinger | H05G 1/10 378/203 |
| 2006/0210020 | A1 | 9/2006 | Takahashi et al. | |
| 2006/0280289 | A1 | 12/2006 | Hanington et al. | |
| 2007/0217574 | A1 | 9/2007 | Beyerlein | |
| 2008/0107235 | A1 | 5/2008 | Sundaram | |
| 2008/0185970 | A1 | 8/2008 | Hunt et al. | |
| 2009/0010393 | A1 * | 1/2009 | Klinkowstein | H05G 1/10 378/140 |
| 2010/0189225 | A1 | 7/2010 | Ernest et al. | |
| 2011/0178744 | A1 | 7/2011 | Seemann et al. | |
| 2013/0077758 | A1 | 3/2013 | Miller | |
| 2013/0121472 | A1 | 5/2013 | Wang | |
| 2013/0136237 | A1 | 5/2013 | Wang | |
| 2013/0163725 | A1 | 6/2013 | Hansen et al. | |
| 2013/0170623 | A1 | 7/2013 | Reynolds et al. | |
| 2013/0223109 | A1 | 8/2013 | Wang | |
| 2014/0219424 | A1 | 8/2014 | Smith et al. | |
| 2014/0314164 | A1 | 10/2014 | Zhao et al. | |

FOREIGN PATENT DOCUMENTS

| | | |
|---|---|---|
| DE | 19818057 | 11/1999 |
| GB | 1252290 | 11/1971 |
| JP | 5135722 | 6/1993 |
| JP | 08315783 | 11/1996 |
| JP | 2003/007237 | 1/2003 |

* cited by examiner

GRID VOLTAGE GENERATION FOR X-RAY TUBE

CLAIM OF PRIORITY

This is a divisional of U.S. patent application Ser. No. 14/038,226, filed Sep. 26, 2013; which claims priority to U.S. Provisional Patent Application Ser. No. 61/740,944, filed on Dec. 21, 2012; which are hereby incorporated herein by reference in their entirety.

FIELD OF THE INVENTION

The present application is related generally to x-ray sources.

BACKGROUND

At least one grid can be disposed between an anode and a cathode of an x-ray tube for improved electron beam control and for a smaller electron beam spot size, and a resulting smaller x-ray spot size. The grid can have a voltage that is different from a voltage of an electron emitter on the cathode. If two grids are used, one grid can have a voltage that is more positive than the voltage of the electron emitter and the other grid can have a voltage that is less positive than the voltage of the electron emitter. The electron emitter can have a very large absolute value of voltage, such as negative tens of kilovolts for example. Voltage for the electron emitter can be provided by a primary high voltage multiplier ("primary HVM") and a grid high voltage multiplier ("grid HVM").

One method to provide voltage to the grid(s) is to use an alternating current source, which can be connected to ground at one end. The alternating current source can provide alternating current to the grid HVM. An input to the grid HVM can be electrically connected to the primary HVM. The grid HVM can then generate a voltage for the grid that is more positive or less positive than the voltage provided by the HVM. For example, the primary HVM might provide negative 40 kV, a grid may generate a negative 500 volts, thus providing negative 40.5 kV to a grid. If there is a second grid HVM, it may be configured to generate a positive voltage, such as positive 500 volts for example, thus providing negative 39.5 kV to a second grid. Typically, voltage to each grid may be controlled. Typically only one grid at a time would be used.

A problem of the previous design is a very large voltage differential between the alternating current source and the grid HVM. The alternating current source might provide an alternating current having an average value of zero or near zero volts. The alternating current source can transfer this alternating current signal, through a transformer, to the grid HVM, which has a very large DC bias, such as negative 40 kilovolts for example.

In order to prevent arcing between the alternating current source and the grid HVM, special precautions may be needed, such as a large amount of insulation on transformer primary and secondary wires, or other voltage standoff methods. This added insulation or other voltage standoff methods can result in an increased power supply size and weight, which can be undesirable. Also, the increased insulation or other voltage standoff methods can result in power transfer inefficiencies, thus resulting in wasted electrical power. Power supply size, weight, and power loss are especially significant for portable x-ray sources. Furthermore, the large voltage difference between the grid HVM and the alternating current source (e.g. tens of kilovolts), can result in failures due to arcing, in spite of added insulation, because it is difficult to standoff such large voltages without an occasional failure.

SUMMARY

It has been recognized that it would be advantageous to improve electron beam control, have a smaller electron beam spot size, and have a smaller x-ray spot size. It has been recognized that it would be advantageous to reduce the size and weight of x-ray sources, to reduce power loss, and to avoid arcing. The present invention is directed to an x-ray source and a method for controlling an electron beam of an x-ray tube that satisfies these needs.

The x-ray source can comprise an x-ray tube and a power supply. The x-ray tube can comprise an anode attached to an evacuated enclosure, the anode configured to emit x-rays; a cathode including an electron emitter attached to the evacuated enclosure, the electron emitter configured to emit electrons towards the anode; and an electrically conducting grid disposed between the electron emitter and the anode, with a gap between the grid and the anode, and a gap between the grid and the electron emitter.

The power supply can comprise an internal grid control configured to provide alternating current and a grid high voltage multiplier electrically coupled between the internal grid control and the grid. The grid high voltage multiplier can be configured to receive alternating current from the internal grid control and generate a direct current ("DC") voltage based on the alternating current, and to provide the DC voltage to the grid. A primary high voltage multiplier can be configured to provide a DC bias voltage at a high voltage connection to the electron emitter and the grid high voltage multiplier. Electrically insulating potting can substantially surround a cathode end of an exterior of the x-ray tube, a high voltage connection end of an exterior of the primary high voltage multiplier, the grid high voltage multiplier, and the internal grid control.

A method for controlling an electron beam of an x-ray tube can comprise obtaining an x-ray tube and control electronics and sending a light control signal. Obtaining an x-ray tube and control electronics can include obtaining (1) an anode attached to an evacuated enclosure, the anode configured to emit x-rays; (2) an electron emitter attached to the evacuated enclosure and configured to emit electrons towards the anode; (3) an electrically conducting grid disposed between the electron emitter and the anode, with a gap between the grid and the anode, and a gap between the grid and the electron emitter; (4) an internal grid control configured to provide alternating current; (5) a grid high voltage multiplier electrically coupled between the internal grid control and the grid, configured to receive alternating current from the internal grid control and generate a direct current ("DC") voltage based on the alternating current; and configured to provide the DC voltage to the grid; (6) a primary high voltage multiplier electrically coupled to and configured to provide a DC bias voltage to the electron emitter and to the grid high voltage multiplier; and (7) electrically insulating potting substantially surrounding a cathode end of an exterior of the x-ray tube, at least part of the primary high voltage multiplier, the grid high voltage multiplier, and the internal grid control. Sending a light control signal can comprise sending a light control signal to the internal grid control, the internal grid control modifying the alternating current to the grid high voltage multiplier based on the light control signal, and the grid high voltage multiplier modifying the grid voltage based on the modified alternating current.

REFERENCE NUMBERS

Figure 1:
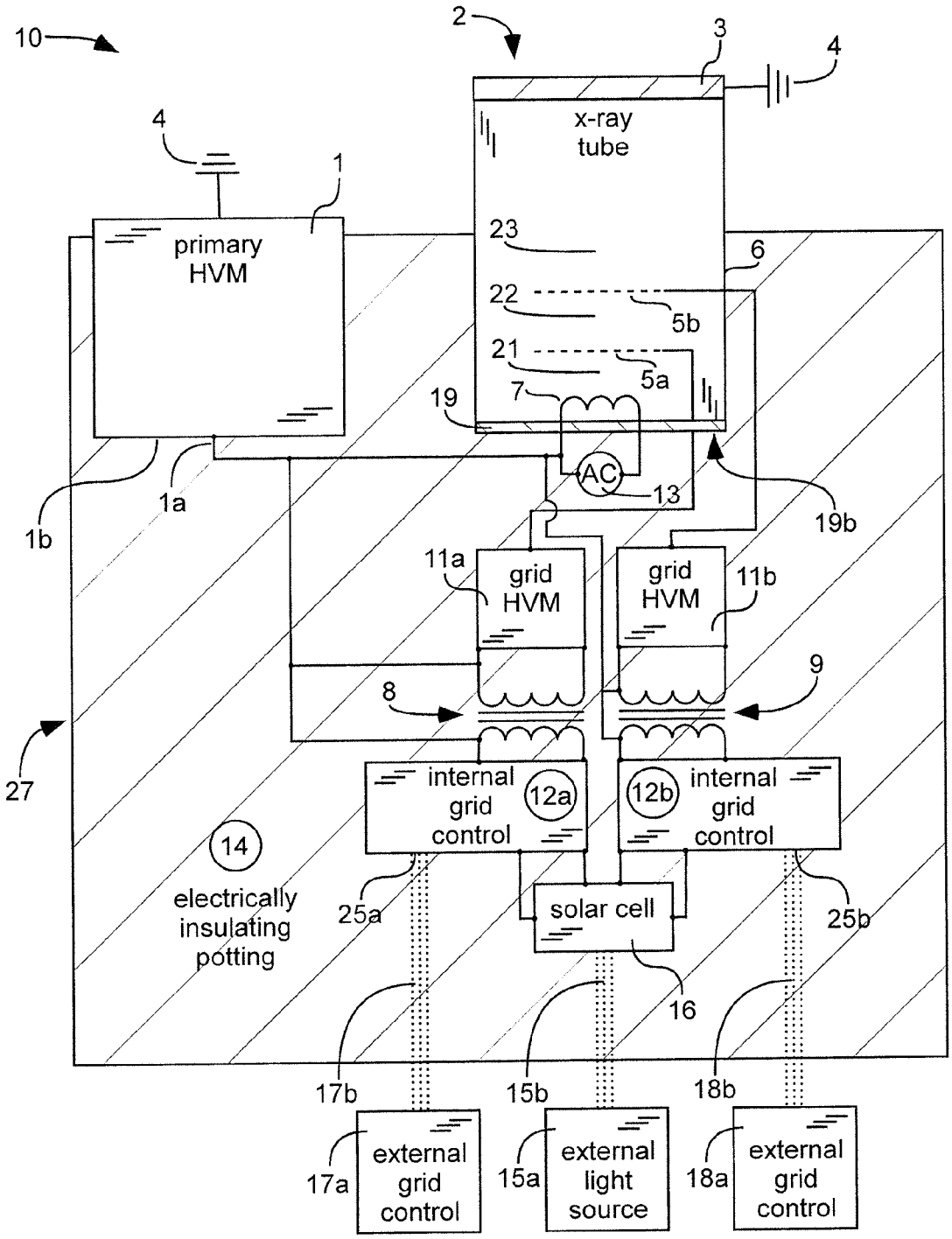
FIG. 1 is a schematic of an x-ray source, with two grids and associated controls for each, and in which the potting is substantially transparent to light, in accordance with an embodiment of the present invention.

1 primary high voltage multiplier ("primary HVM")
1*a* high voltage connection for the primary HVM
1*b* high voltage connection end of an exterior of the primary HVM
2 x-ray tube
3 anode
4 ground
5*a* first electrically conducting grid
5*b* second electrically conducting grid
6 evacuated enclosure
7 electron emitter
8 first transformer
9 second transformer
10 x-ray source
11*a* first grid high voltage multiplier ("first grid HVM")
11*b* second grid high voltage multiplier ("second grid HVM")
12*a* first internal grid control
12*b* second internal grid control
13 alternating current source for the electron emitter
14 electrically insulating potting
15*a* external light source
15*b* light beam transmitting through transparent potting
15*c* power fiber optic cable
16 solar cell
17*a* first external grid control
17*b* first control signal as a light beam
17*c* first control fiber optic cable
18*a* second external grid control
18*b* second control signal as a light beam
18*c* second control fiber optic cable
19 cathode
19*b* cathode end of an exterior of the x-ray tube
21 gap between grid and electron emitter
22 gap between the two grids
23 gap between grid and anode
25*a* first light sensor of the first internal grid control
25*b* second light sensor of the second internal grid control
27 power supply
31 battery

DETAILED DESCRIPTION

As illustrated in FIGS. 1-6, x-ray sources 10, 20, 30, 40, 50, and 60 are shown comprising, an x-ray tube 2 and a power supply 27. The x-ray tube 2 can include an anode 3 attached to an evacuated enclosure 6, the anode 3 configured to emit x-rays; a cathode including an electron emitter 7 attached to the evacuated enclosure 6, the electron emitter 7 configured to emit electrons towards the anode 3; and an electrically conducting grid 5*a* disposed between the electron emitter 7 and the anode 3, with a gap 23 between the grid 5*a* and the anode 3, and a gap 21 between the grid 5*a* and the electron emitter 7.

The power supply 27 for the x-ray tube 2 can comprise an internal grid control 12*a* configured to provide alternating current; a grid high voltage multiplier ("grid HVM") 11*a* electrically coupled between the internal grid control 12*a* and the grid 5*a*; a primary high voltage multiplier ("primary HVM) 1; and electrically insulating potting 14.

The grid HVM 11*a* can be configured to receive alternating current from the internal grid control 12*a*, generate a direct current ("DC") voltage based on the alternating current, and provide the DC voltage to the grid 5*a*. The primary HVM 1 can be configured to provide a DC bias voltage at a high voltage connection 1*a* to the electron emitter 7. The primary HVM 1 can be configured to provide a DC bias voltage at a high voltage connection is to the grid HVM 11*a*. The primary HVM 1 can be configured to provide a DC bias voltage at a high voltage connection 1*a* to the internal grid control 12*a*. The grid HVM 11*a* might provide a DC voltage for the grid 5*a* that is anywhere from less than a volt to a few volts to over a hundred volts greater than or less than the DC bias voltage provided by the primary HVM 1. The grid HVM 11*a* can provide a DC voltage for the grid 5*a* that is at least 10 volts greater than or less than the DC bias voltage provided by the primary HVM 1 in one aspect, at least 100 volts greater than or less than the DC bias voltage provided by the primary HVM 1 in another aspect, or at least 1000 volts greater than or less than the DC bias voltage provided by the primary HVM 1 in another aspect.

As shown in FIGS. 1-4 and 6, a transformer 8 can electrically couple the internal grid control 12*a* and the grid HVM 11*a* and can be configured to transfer electrical power from the internal grid control 12*a* to the grid HVM 11*a*. A transformer is typically used for conversion of direct current to alternating current, and may also be used to step up voltage from the internal grid control 12*a* to the grid HVM 11*a*. As shown in FIG. 5, the internal grid control 12*a* can be electrically connected to the grid HVM 11*a* without a transformer.

As shown in FIGS. 1-6, the electrically insulating potting 14 can substantially surround a cathode end 19*b* of an exterior of the x-ray tube 2, a high voltage connection end 1*b* of an exterior of the primary HVM 1, the grid HVM 11*a*, and the internal grid control 12*a*.

The internal grid control 12*a* can have a light sensor 25*a* configured to receive a light control signal 17*b* emitted by an external grid control 17*a*. The internal grid control 12*a* can be configured to modify the alternating current to the grid HVM 11*a* based on the light control signal 17*b* and the grid HVM 11*a* can be configured to modify the grid 5*a* voltage based on the modified alternating current.

As shown in FIGS. 1, 3, and 5-6, the potting 14 can be substantially transparent to light (the wavelength(s) of light emitted by the external grid control 17*a*), and the light control signal 17*b* can be emitted from the external grid control 17*a* directly through the potting 14 to the internal grid control 12*a*. As shown in FIGS. 2 & 4, a control fiber optic cable 17*c* can extend through the potting 14 and can couple the light sensor 25*a* of the internal grid control 12*a* to the external grid control 17*a*, and the light control signal 17*b* can be emitted from the external grid control 17*a* through the control fiber optic cable 17*c* to the light sensor 25*a*.

The x-ray sources 10, 20, 30, 40, 50, and 60 can further comprise a solar cell 16 electrically coupled to the internal grid control 12*a* and disposed in the potting 14. The solar cell 16 can be configured to receive light 15*b* emitted by an external light source 15*a* and convert energy from the light 15*b* into electrical energy for the internal grid control 12*a*. Various types of light sources may be used, such as an LED or a laser for example. It can be important to select a light source with sufficient power output.

As shown in FIGS. 1, 3, and 5-6, the potting 14 can be substantially transparent to light (the wavelength(s) of light emitted by the external light source 15*a*), and the light 15*b* from the external light source 15*a* can be emitted from the external light source 15*a* directly through the potting 14 to the solar cell 16. As shown in FIGS. 2 & 4, a power fiber optic cable 15*c* can extend through the potting 14 and can couple the solar cell 16 to the external light source 15*a*, and the light 15*b* from the external light source 15*a* can be emitted from the external light source 15*a* through the power fiber optic cable 15*c* to the solar cell 16.

Figure 2:
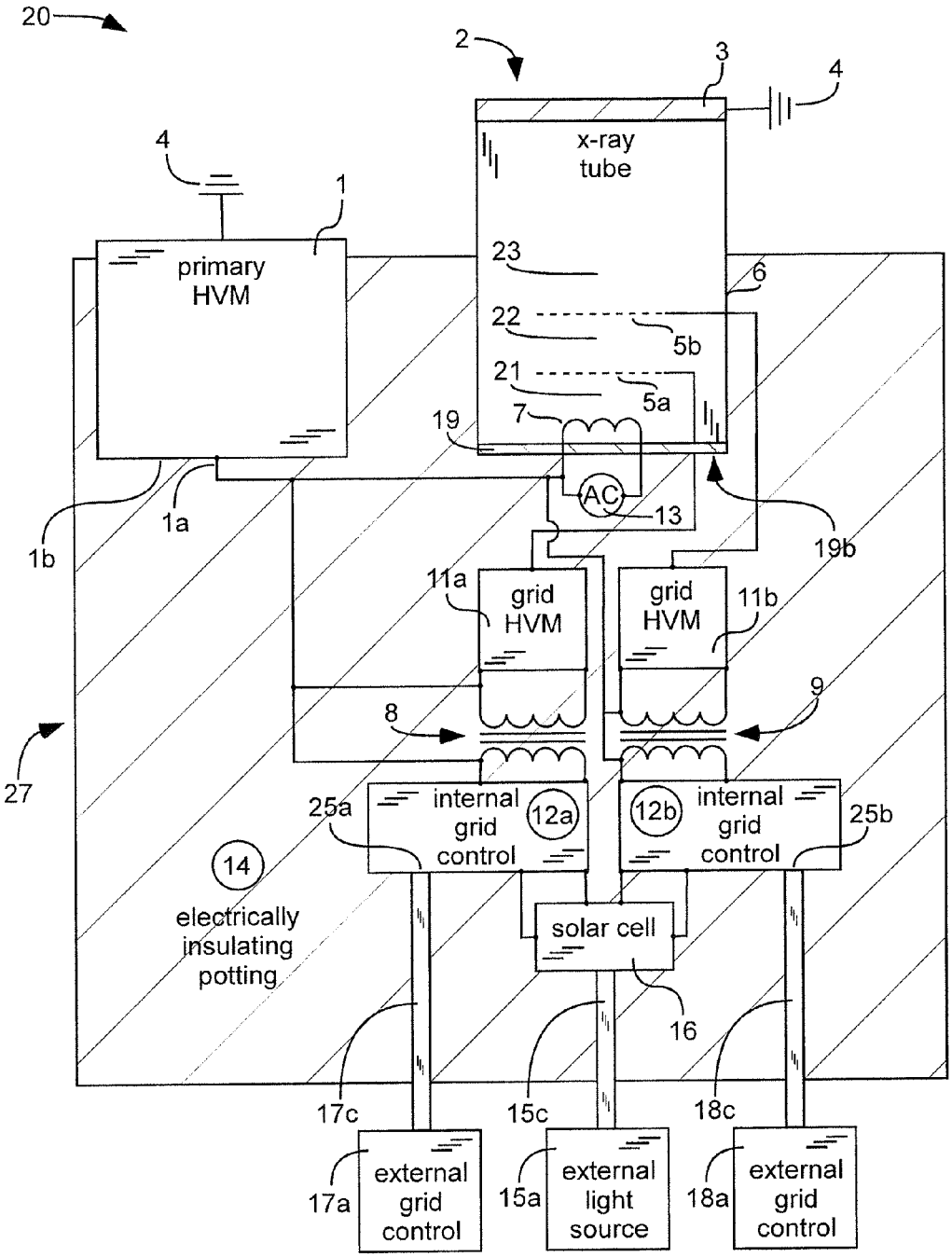
FIG. 2 is a schematic of an x-ray source, with two grids and associated controls for each, and light is transmitted through fiber optic cables, in accordance with an embodiment of the present invention.
Figure 3:
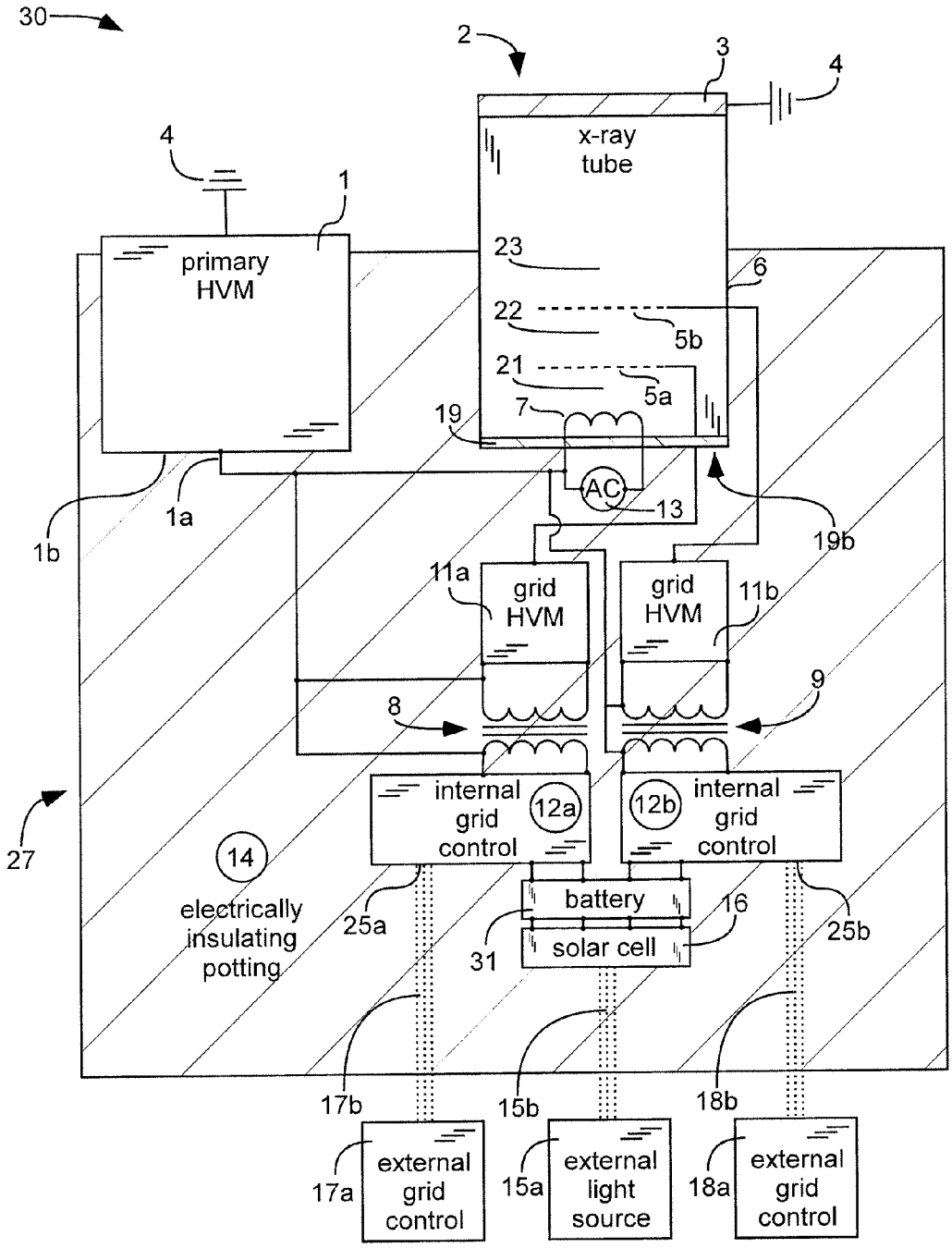
FIG. 3 is a schematic of an x-ray source, with two grids and associated controls for each, in which the potting is substantially transparent to light, and power for the internal grid controls is provided by a battery, in accordance with an embodiment of the present invention.
Figure 4:
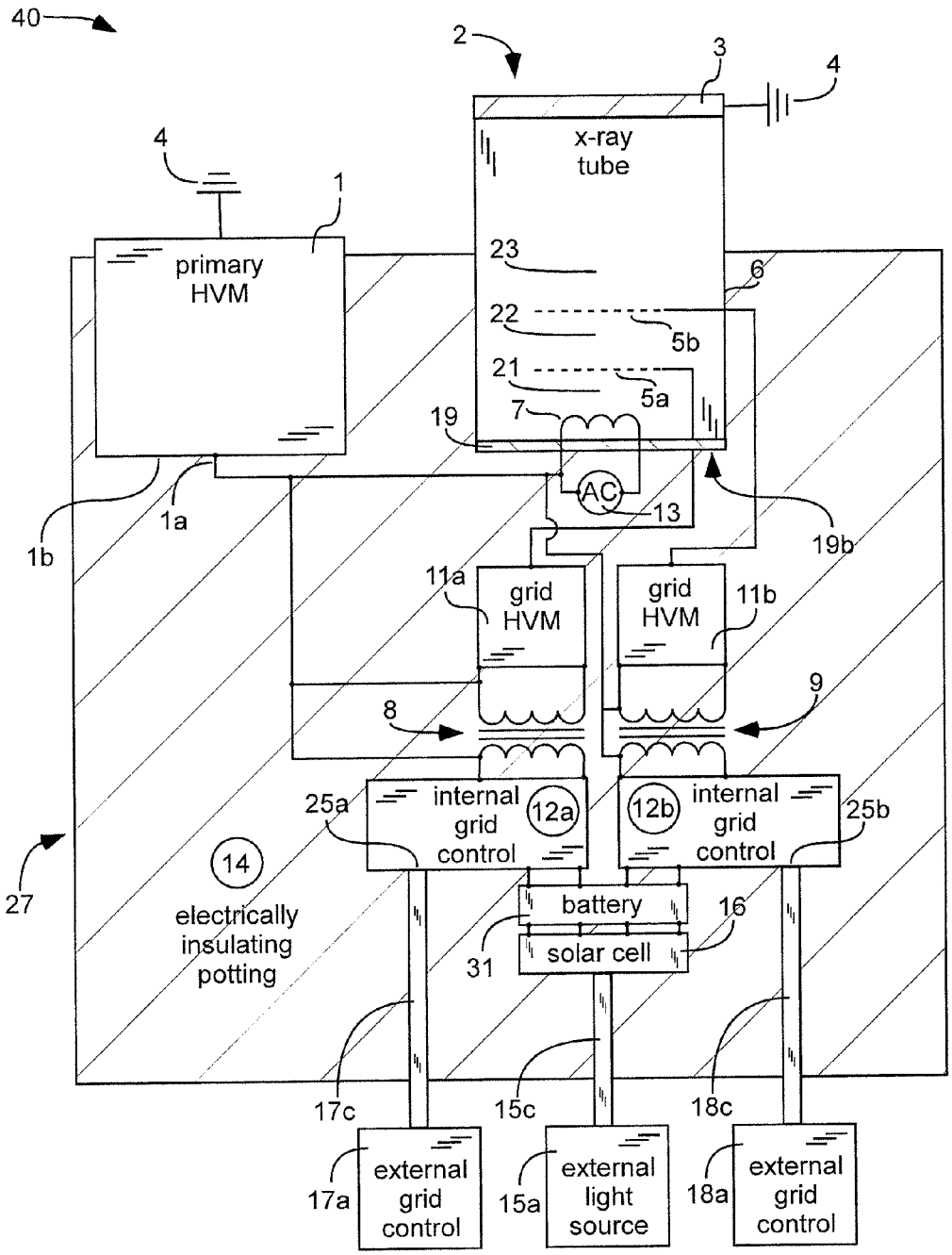
FIG. 4 is a schematic of an x-ray source, with two grids and associated controls for each, light is transmitted through fiber optic cables, and power for the internal grid controls is provided by a battery, in accordance with an embodiment of the present invention.
Figure 5:
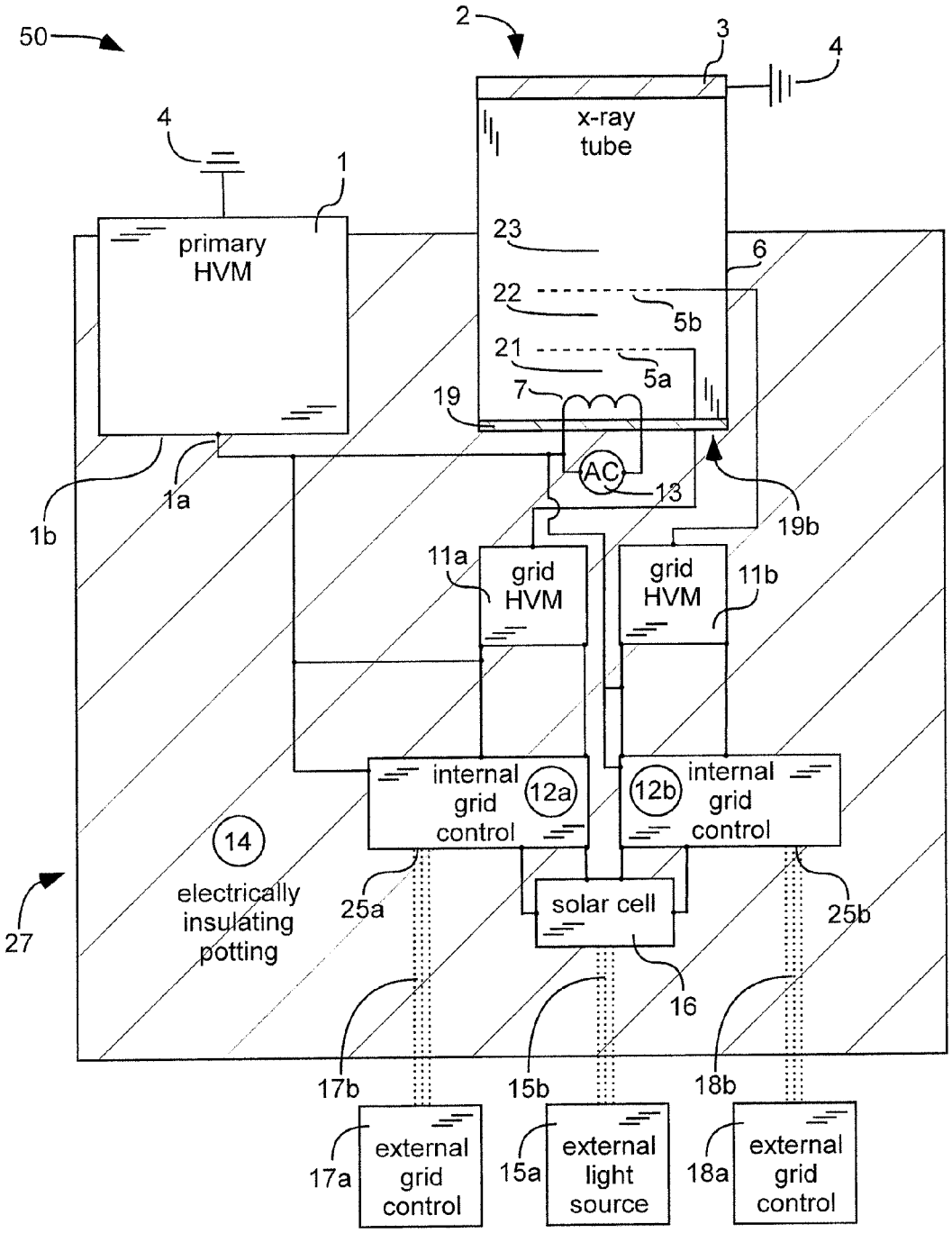
FIG. 5 is a schematic of an x-ray source, in which the internal grid control is directly connected to the grid HVMs with no transformer between, in accordance with an embodiment of the present invention.
Figure 6:
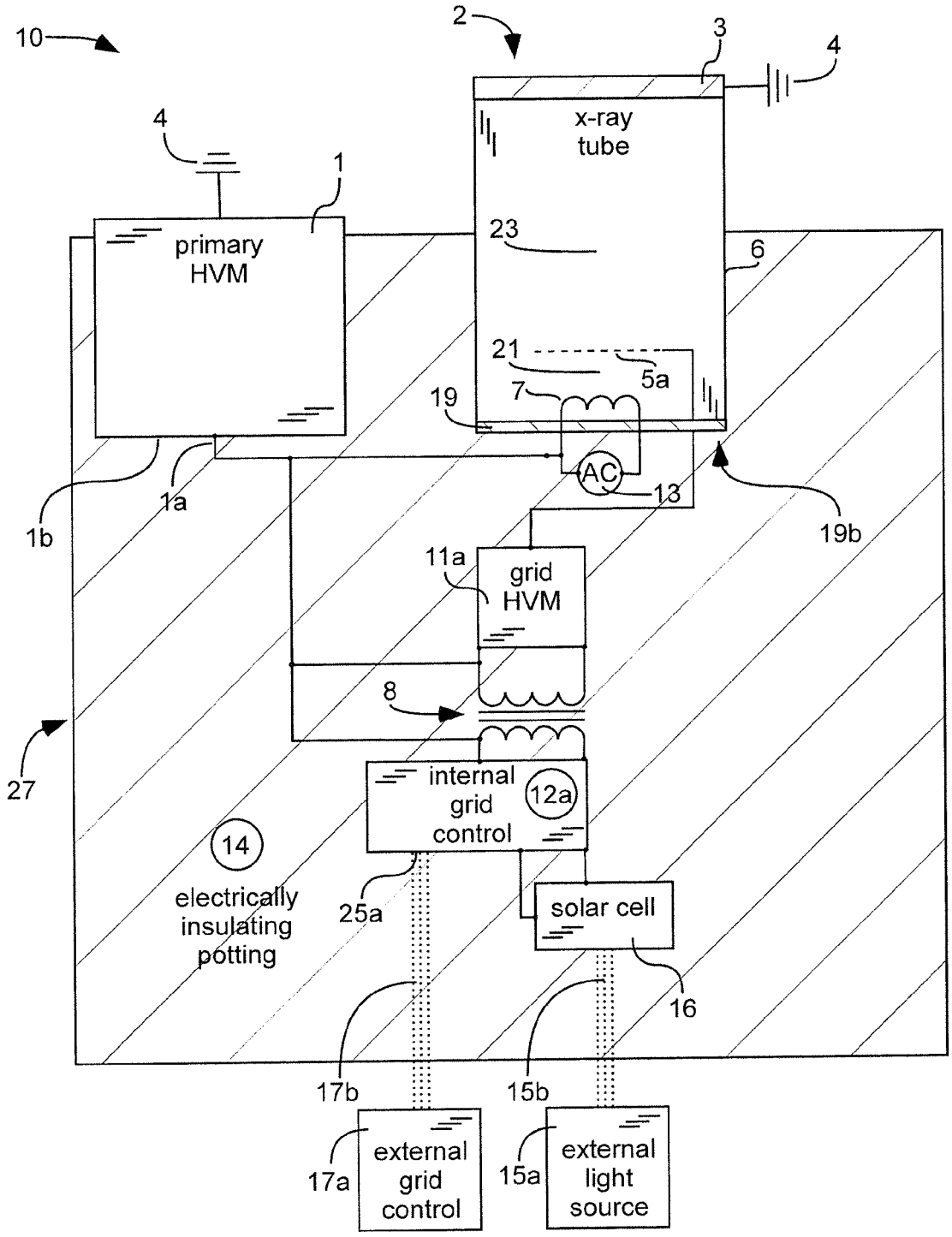
FIG. 6 is a schematic of an x-ray source, with a single grid and associated controls, in accordance with an embodiment of the present invention.

As shown in FIGS. 3 & 4, the x-ray sources 30 and 40 can comprise a battery 31 electrically coupled to the internal grid control 12*a* and to the solar cell 16 and disposed in the potting 14. The solar cell 16 can be configured to provide electrical power to the battery 31 to recharge the battery 31. The battery 31 can be configured to provide electrical power to the internal grid control 12*a*. The battery can be recharged when the x-ray source 30 or 40 is not in use, then the x-ray source can be used without the external light source 15*a* for the life of the battery. A battery recharger can be associated with the solar cell 16 or with the battery 31. It can be important to select an external light source 15*a*, such as a laser for example, with sufficient power to recharge the battery in a reasonable amount of time. Alternatively, if no battery 31 is used, as shown in FIGS. 1, 2, 5, and 6, then the external light source 15 can attached to the x-ray source 10, 20, or 50 and can be in use to provide light to the solar cell 16 while the x-ray source is in operation.

Although a single grid 5*a* may be used, typically two grids 5*a-b* will be used, with one grid having a more positive voltage and the other grid having a less positive voltage than the voltage provided by the primary HVM 1. This design can allow for improved electron beam control. X-ray sources 10, 20, 30, 40, and 50 in FIGS. 1-5 show two grids 5*a-b* and associated controls, but x-ray source 60 in FIG. 6 includes only a single grid 5*a* with associated controls. A design with a single grid can be simpler, easier, and cheaper to make.

Thus, as shown in FIGS. 1-5, the grid 5*a* can be called a first grid 5*a*, and the x-ray sources 10, 20, 30, 40, and 50 can further comprise a second electrically conducting grid 5*b* disposed between the first grid 5*a* and the anode 3, with a gap 23 between the second grid 5*b* and the anode 3, and a gap 22 between the first grid 5*a* and the second grid 5*b*. The internal grid control 12*a* can be called a first internal grid control 12*a*, and the x-ray sources 10, 20, 30, 40, and 50 can further comprise a second internal grid control 12*b* configured to provide alternating current. The DC voltage can be called a first DC voltage. The grid HVM 11*a* can be called a first grid HVM 11*a*, and the x-ray sources 10, 20, 30, 40, and 50 can further comprise a second grid high voltage multiplier ("second grid HVM") 11*b* electrically coupled between the second internal grid control 12*a* and the second grid 5*b*. The second grid HVM 11*b* can be configured to: (1) receive alternating current from the second internal grid control 12*b*, (2) generate a second DC voltage based on the alternating current from the second internal grid control 12*b*, and (3) provide the second DC voltage to the second grid 5*b*.

Either the first grid HVM 11*a* or the second grid HVM 11*b* can be configured to provide a DC voltage to the first grid 5*a* or to the second grid 5*b*, that is more positive than the DC bias voltage provided by the primary HVM 1, and the other of the first grid HVM 11*a* or the second grid HVM 11*b* can be configured to provide a DC voltage to the other of the first grid 5*a* or second grid 5*b* that is less positive than the DC bias voltage provided by the primary HVM 1.

A Cockcroft-Walton multiplier can be used for the grid HVMs 11*a-b*. A schematic of a Cockcroft-Walton multiplier is shown on FIG. 6 of U.S. Pat. No. 7,839,254, incorporated herein by reference. Diodes in a Cockcroft-Walton multiplier can be disposed in one direction to generate a more positive voltage, or in an opposite direction, to generate a less positive voltage.

The high voltage connection 1*a* of the primary HVM 1 can be electrically coupled to the second grid HVM 11*b*. The high voltage connection 1*a* of the primary HVM 1 can be electrically coupled to the second internal grid control 12*b*. Electrically insulating potting 14 can substantially surround the second grid HVM 11*b* and the second internal grid control 12*b*.

The transformer 8 can define a first transformer. A second transformer 9 can be disposed in the potting 14 and electrically coupled between the second internal grid control 12*b* and the second grid HVM 11*b*. The second transformer 9 can be configured to transfer electrical power from the second internal grid control 12*b* to the second grid HVM 11*b*.

The external grid control 17*a* can be a first external grid control 17*a*. The light control signal 17*b* from the first external grid control 17*a* can be a first light control signal 17*b*. A second external grid control 18*a* can emit a second light control signal 18*b* for control of the second internal grid control 12*b*. The second internal grid control 12*b* can have a second light sensor 25*b* and can be configured to receive the second light control signal 18*b* emitted by the second external grid control 18*a*. The second internal grid control 12*b* can be configured to modify the alternating current to the second grid HVM 11*b* based on the second light control signal 18*b*. The second grid HVM 11*b* can be configured to modify the second grid 5*b* voltage based on the modified alternating current.

As shown in FIGS. 1, 3, and 5, the potting 14 can be substantially transparent to light (the wavelength(s) of light emitted by the external grid control 18*b*), and the second light control signal 18*b* can be emitted from the second external grid control 18*a* directly through the potting 14 to the second internal grid control 12*b*. As shown in FIGS. 2 and 4, the control fiber optic cable 17*c* can define a first control fiber optic cable 17*c* and a second control fiber optic cable 18*c* can extend through the potting 14 and can couple the light sensor 25*b* of the second internal grid control 12*b* to the second external grid control 18*a*. The second light control signal 18*b* can be emitted from the external grid control 18*a* through the control second fiber optic cable 18*c* to the second light sensor 25*b*.

As shown in FIGS. 3-4, a solar cell 16 and a battery 31 can be electrically coupled to each other and to the first internal grid control 12*a* and to the second internal grid control 12*b* and can be disposed in the potting 14. The solar cell 16 can be configured to receive light emitted by an external light source 15*a* and convert energy from the light into electrical energy. The solar cell 16 can be configured to charge the battery 31 with electrical power. The battery 31 can be configured to provide electrical power to the first internal grid control 12*a* and to the second internal grid control 12*b*. Although shown in FIGS. 3-4 is a solar cell 16 providing electrical power for a single battery 31, the single battery providing electrical power for both internal grid controls 12*a-b*, a separate solar cell and a separate battery may be used for each internal grid control.

Alternatively, as shown in FIGS. 1-2 and 5, the solar cell 16 can be directly electrically coupled to the first internal grid control 12*a* and to the second internal grid control 12*b* and can be disposed in the potting 14. The solar cell 16 can be configured to receive light emitted by an external light source 15*a* and convert energy from the light into electrical energy. The solar cell 16 can be configured to directly provide the first internal grid control 12*a* and to the second internal grid control 12*b* with electrical power. Although shown in FIGS. 1-2 and 5 is a solar cell 16 providing electrical power to both internal grid controls 12*a-b*, a separate solar cell may be used for each internal grid control.

The grid(s) 5*a-b* can allow for improved electron beam control, a smaller electron beam spot size, and a smaller x-ray spot size. Encasing the internal grid control(s) 12*a-b* in potting 14, and controlling them via external grid control(s) 17*a* and/or 18*a* allows the internal grid control to be maintained at approximately the same voltage as an input to the grid HVM(s) 11*a-b*, which can avoid a need for a large amount of insulation on transformer wires between the internal grid control(s) 12*a-b* and the grid HVM(s) 11*a-b*. This can result in reduced size and weight of the x-ray sources 10, 20, 30, 40, 50, and 60 and reduced power loss due to transformer inefficiencies and help to avoid arcing.

Method

A method for controlling an electron beam of an x-ray tube 2 can comprise obtaining an x-ray tube 2 and control electronics with:

1. an anode 3 attached to an evacuated enclosure 6, the anode 3 configured to emit x-rays;
2. an electron emitter 7 attached to the evacuated enclosure 6 and configured to emit electrons towards the anode 3;
3. an electrically conducting grid 5*a* disposed between the electron emitter 7 and the anode 3, with a gap 23 between the grid 5*a* and the anode 3, and a gap 21 between the grid 5*a* and the electron emitter 7;
4. an internal grid control 12*a* configured to provide alternating current;
5. a grid HVM 11*a:*
   a. electrically coupled between the internal grid control 12*a* and the grid 5*a;*
   b. configured to receive alternating current from the internal grid control 12*a* and generate a direct current ("DC") voltage based on the alternating current; and
   c. configured to provide the DC voltage to the grid 5*a;*
6. a primary HVM 1 electrically coupled to and configured to provide a DC bias voltage to the electron emitter 7;
7. the primary HVM 1 electrically coupled to and configured to provide a DC bias voltage to the internal grid control 12*a* and/or to the grid HVM 11*a*; and
8. electrically insulating potting 14 substantially surrounding a cathode end 19*b* of an exterior of the x-ray tube 2, at least part of the primary HVM 1, the grid HVM 11*a*, and the internal grid control 12*a*.

The method can further comprise sending a light control signal 17*b* to the internal grid control 12*a*, the internal grid control 12*a* modifying the alternating current to the grid HVM 11*a* based on the light control signal 17*b*, and the grid HVM 11*a* modifying the grid voltage based on the modified alternating current.

The method can further comprise sending light energy 15*b* to a solar cell 16, the solar cell 16 receiving the light and converting energy from the light into electrical energy. The electrical energy can be used to charge a battery 31 with electrical power and the battery 31 can provide electrical power to the internal grid control 12*a*. Alternatively, the electrical energy can be used to provide electrical power to the internal grid control 12*a* directly.

The potting 14 in the method can be substantially transparent to light (transparent to the wavelength(s) of light emitted by the external grid controls 17*a* and 18*a* and/or light emitted by the external light source 15*a*). Sending the light control signal 17*b* can include sending the light control signal 17*b* through the potting 14. Sending light energy 15*b* to a solar cell 16 can include sending the light energy 15*b* through the potting.

The control electronics in the method can further comprise a control fiber optic cable 17*c* extending through the potting 14 and coupling the internal grid control 12*a* to the external grid control 17*a*. The method step of sending a light control signal can include sending the light control signal 17*b* through the control fiber optic cable 17*c*.

The control electronics in the method can further comprise a power fiber optic cable 15*c* extending through the potting 14 and coupling the solar cell 16 to the external light source 15*a*. The method step of sending a sending light energy 15*b* to a solar cell 16 can include sending the light energy 15*b* through the power fiber optic cable 15*c*.

The method step of obtaining an x-ray tube 2 and control electronics can further include:

1. the grid 5*a* is a first grid 5*a*, and further comprising a second electrically conducting grid 5*b* disposed between the first grid 5*a* and the anode 3, with a gap 23 between the second grid 5*b* and the anode 3, and a gap 22 between the first grid 5*a* and the second grid 5*b;*
2. the internal grid control 12*a* is a first internal grid control 12*a*, and further comprising a second internal grid control 12*b* configured to provide alternating current;
3. the DC voltage is a first DC voltage;
4. the grid HVM 11*a* is a first grid HVM 11*a*, and further comprising a second grid HVM 11*b:*
   a. electrically coupled between the second internal grid control 12*b* and the second grid 5*b;*
   b. configured to receive alternating current from the second internal grid control 12*b* and generate a second direct current ("DC") voltage based on the alternating current; and
   c. configured to provide the second DC voltage to the second grid 5*b;*
5. one of the first grid HVM 11*a* or the second grid HVM 11*b* is configured to provide a DC voltage to the first grid 5*a* or second grid 5*b* that is more positive than the DC bias voltage provided by the primary HVM 1, and the other of the first grid HVM 11*a* or the second grid HVM 11*b* is configured to provide a DC voltage to the other of the first grid 5*a* or the second grid 5*b* that is less positive than the DC bias voltage provided by the primary HVM 1;
6. the primary HVM 1 electrically coupled to the second grid HVM 11*b* and/or to the second internal grid control 12*b*; and 7. the electrically insulating potting 14 substantially surrounding the second grid HVM 11*b* and the second internal grid control 12*b*.

The method step of obtaining an x-ray tube 2 and control electronics can further include a solar cell 16 and a battery 31 electrically coupled to each other. The battery 31 can be electrically coupled to the first internal grid control 12*a* and to the second internal grid control 12*b*. The battery 31 can be disposed in the potting 14. The solar cell 16 can be configured to receive light emitted by an external light source 15*a* and convert energy from the light into electrical energy. The solar cell 16 can be configured to charge the battery 31 with electrical power. The battery 31 can be configured to provide electrical power to the first internal grid control 12*a* and to the second internal grid control 12*b*.

The method step of obtaining an x-ray tube 2 and control electronics can further include a solar cell 16 electrically coupled to the first internal grid control 12*a* and to the second internal grid control 12*b* and disposed in the potting 14. The solar cell 16 can be configured to receive light emitted by an external light source 15*a* and convert energy from the light into electrical energy. The solar cell 16 can be configured to directly provide electrical power to the first internal grid control 12*a* and to the second internal grid control 12*b*.

Sending the light control signal 17*b* in the method can be a first light control signal 17*b*, and the method may further comprise sending a second light control signal 18*b* to the second internal grid control 12*b*, the second internal grid control 12*b* modifying the alternating current to the second grid HVM 11*b* based on the second light control signal 18*b*, and the second grid HVM 11*b* modifying the second grid voltage based on the modified alternating current to the second grid HVM 11*b*.

What is claimed is:

1. An x-ray source comprising:

a. an x-ray tube including:

i. an anode attached to an evacuated enclosure, the anode configured to emit x-rays;

ii. a cathode including an electron emitter attached to the evacuated enclosure, the electron emitter configured to emit electrons towards the anode;

iii. an electrically conducting grid disposed between the electron emitter and the anode, with a gap between the grid and the anode, and a gap between the grid and the electron emitter;

b. an internal grid control configured to provide alternating current;

c. a grid high voltage multiplier electrically coupled between the internal grid control and the grid;

d. the grid high voltage multiplier configured to receive alternating current from the internal grid control, generate a direct current ("DC") voltage based on the alternating current, and provide the DC voltage to the grid;

e. a primary high voltage multiplier configured to provide a DC bias voltage at a high voltage connection to the electron emitter, the grid high voltage multiplier, and the internal grid control;

f. electrically insulating potting substantially surrounding a cathode end of an exterior of the x-ray tube, at least part of the primary high voltage multiplier including a high voltage connection end, the grid high voltage multiplier, and the internal grid control; and g. a solar cell electrically coupled to the internal grid control and disposed in the potting, and wherein the solar cell is configured to receive light emitted by an external light source and configured to convert energy from the light into electrical energy for the internal grid control.

2. The x-ray source of claim 1, further comprising a battery electrically coupled to the internal grid control and to the solar cell and disposed in the potting, the solar cell is configured to provide electrical power to the battery to recharge the battery, and the battery is configured to provide electrical power to the internal grid control.

3. The x-ray source of claim 1, wherein the potting is substantially transparent to light, and the light from the external light source is emitted through the potting to the solar cell.

4. The x-ray source of claim 1, further comprising a power fiber optic cable extending through the potting and coupling the solar cell to the external light source, and the light is emitted from the external light source through the power fiber optic cable to the solar cell.

5. The x-ray source of claim 1, wherein:

a. the internal grid control is configured to receive a light control signal emitted by an external grid control;

b. the internal grid control is configured to modify the alternating current to the grid high voltage multiplier based on the light control signal; and c. the grid high voltage multiplier is configured to modify a grid voltage based on the modified alternating current.

6. The x-ray source of claim 5, wherein the internal grid control further comprises a light control sensor that is configured to receive the light control signal.

7. The x-ray source of claim 5, further comprising the external grid control.

8. The x-ray source of claim 5, further comprising a transformer disposed in the potting and wherein:

a. the transformer is electrically coupled between the internal grid control and the grid high voltage multiplier; and b. the transformer is configured to transfer electrical power from the internal grid control to the grid high voltage multiplier.

9. The x-ray source of claim 5, wherein the potting is substantially transparent to light, and the light control signal is emitted from the external grid control through the potting to the internal grid control.

10. The x-ray source of claim 5, further comprising a control fiber optic cable extending through the potting and coupling the light sensor of the internal grid control to the external grid control, and the light control signal is emitted from the external grid control through the control fiber optic cable to the light sensor.

11. The x-ray source of claim 1, wherein:

a. the grid is a first grid, and further comprising a second electrically conducting grid disposed between the first grid and the anode, with a gap between the second grid and the anode, and a gap between the first grid and the second grid;

b. the internal grid control is a first internal grid control, and further comprising a second internal grid control configured to provide alternating current;

c. the DC voltage is a first DC voltage;

d. the grid high voltage multiplier is a first grid high voltage multiplier, and further comprising a second grid high voltage multiplier electrically coupled between the second internal grid control and the second grid;

e. the second grid high voltage multiplier configured to receive alternating current from the second internal grid control, generate a second DC voltage based on the alternating current from the second internal grid control, and provide the second DC voltage to the second grid;

f. one of the first grid high voltage multiplier or the second grid high voltage multiplier is configured to provide a DC voltage to the first grid or to the second grid that is more positive than the DC bias voltage provided by the primary high voltage multiplier, and the other of the first grid high voltage multiplier or the second grid high voltage multiplier is configured to provide a DC voltage to the other of the first grid or second grid that is less positive than the DC bias voltage provided by the primary high voltage multiplier;

g. the high voltage connection of the primary high voltage multiplier electrically coupled to the second grid high voltage multiplier and to the second internal grid control; and h. electrically insulating potting substantially surrounding the second grid high voltage multiplier and the second internal grid control.

12. The x-ray source of claim 11, wherein:

a. the first internal grid control is configured to receive a first light control signal emitted by a first external grid control;

b. the first internal grid control is configured to modify the alternating current to the first grid high voltage multiplier based on the first light control signal;

c. the first grid high voltage multiplier is configured to modify a voltage of the first grid based on the modified alternating current;

d. the second internal grid control is configured to receive a second light control signal emitted by the second external grid control;

e. the second internal grid control is configured to modify the alternating current to the second grid high voltage multiplier based on the second light control signal; and f. the second grid high voltage multiplier is configured to modify the second grid voltage based on the modified alternating current.

13. An x-ray source comprising:

a. an x-ray tube including:

i. an anode attached to an evacuated enclosure, the anode configured to emit x-rays;

ii. a cathode including an electron emitter attached to the evacuated enclosure, the electron emitter configured to emit electrons towards the anode;

iii. an electrically conducting grid disposed between the electron emitter and the anode, with a gap between the grid and the anode, and a gap between the grid and the electron emitter;

b. an internal grid control configured to provide alternating current;

c. a grid high voltage multiplier electrically coupled between the internal grid control and the grid;

d. the grid high voltage multiplier configured to receive alternating current from the internal grid control, generate a direct current ("DC") voltage based on the alternating current, and provide the DC voltage to the grid;

e. a primary high voltage multiplier configured to provide a DC bias voltage at a high voltage connection to the electron emitter, the grid high voltage multiplier, and the internal grid control;

f. electrically insulating potting substantially surrounding a cathode end of an exterior of the x-ray tube, at least part of the primary high voltage multiplier including a high voltage connection end, the grid high voltage multiplier, and the internal grid control; and g. a solar cell and a battery disposed in the potting and electrically coupled to each other and to the internal grid control;

h. the solar cell configured to receive light emitted by an external light source and configured to convert energy from the light into electrical energy to charge the battery with electrical power; and i. the battery configured to provide electrical power to the internal grid control.

14. The x-ray source of claim 13, wherein the potting is substantially transparent to light, and the light from the external light source is emitted through the potting to the solar cell.

15. The x-ray source of claim 13, further comprising a power fiber optic cable extending through the potting and coupling the solar cell to the external light source, and the light is emitted from the external light source through the power fiber optic cable to the solar cell.

16. The x-ray source of claim 13, wherein:

a. the internal grid control is configured to receive a light control signal emitted by an external grid control;

b. the internal grid control is configured to modify the alternating current to the grid high voltage multiplier based on the light control signal; and c. the grid high voltage multiplier is configured to modify a grid voltage based on the modified alternating current.

17. The x-ray source of claim 16, wherein the internal grid control further comprises a light control sensor that is configured to receive the light control signal.

18. The x-ray source of claim 16, further comprising the external grid control.

19. The x-ray source of claim 16, further comprising a transformer disposed in the potting and wherein:

a. the transformer is electrically coupled between the internal grid control and the grid high voltage multiplier; and b. the transformer is configured to transfer electrical power from the internal grid control to the grid high voltage multiplier.

20. The x-ray source of claim 16, wherein the potting is substantially transparent to light, and the light control signal is emitted from the external grid control through the potting to the internal grid control.

* * * * *